US005912108A

United States Patent [19]

Verbeeck et al.

[11] Patent Number: 5,912,108

[45] Date of Patent: Jun. 15, 1999

[54] PROCESSING OF A LIGHT-SENSITIVE SILVER HALIDE PHOTOGRAPHIC MATERIAL

[75] Inventors: Ann Verbeeck, Begijnendijk; Peter Verrept, Avelgem; Freddy Henderickx, Olen, all of Belgium

[73] Assignee: Agfa-Gevaert, N.V., Mortsel, Belgium

[21] Appl. No.: 08/991,345

[22] Filed: Dec. 16, 1997

[30] Foreign Application Priority Data

Dec. 30, 1996 [EP] European Pat. Off. ..... 96203728

[51] Int. Cl.[6] ..... G03C 5/29

[52] U.S. Cl. ..... 430/486; 430/446; 430/489

[58] Field of Search ..... 430/446, 486, 430/489

[56] References Cited

U.S. PATENT DOCUMENTS

| | | | |
|---|---|---|---|
| 4,851,326 | 7/1989 | Ishikawa et al. | 430/380 |
| 5,766,830 | 6/1998 | Shimizu et al. | 430/440 |
| 5,766,832 | 6/1998 | Nishio | 430/446 |

FOREIGN PATENT DOCUMENTS

| | | |
|---|---|---|
| 0 246 624 A2 | 11/1987 | European Pat. Off. . |
| 0 246 624 A3 | 11/1987 | European Pat. Off. . |
| 0 678 772 A1 | 10/1995 | European Pat. Off. . |

OTHER PUBLICATIONS

Patent Abstracts of Japan re JP04/107887 (Fuji Shashin Film), Apr. 27, 1992.

*Primary Examiner*—Hoa Van Le
*Attorney, Agent, or Firm*—Breiner & Breiner

[57] ABSTRACT

A method has been disclosed of processing an image-wise exposed light-sensitive black-and-white silver halide photographic material comprising a support coated on one or both sides thereof with hydrophilic layers, wherein at least one of said layers comprises one or more emulsions having tabular silver halide crystals rich in silver chloride, said method comprising the steps of developing, fixing, rinsing and drying, further characterized in that said developing step proceeds in a black-and-white developer comprising one or more organic compounds inhibiting development, more preferably one or more benzotriazole compounds, and in that said developer is substantially free from bromide ions in favor of a low fog level, a high speed and a sufficiently high covering power of the developed tabular grains.

19 Claims, No Drawings

PROCESSING OF A LIGHT-SENSITIVE SILVER HALIDE PHOTOGRAPHIC MATERIAL

FIELD OF THE INVENTION

This invention is related to a method for processing of a light-sensitive black-and-white silver halide photographic material comprising tabular silver halide emulsions rich in silver chloride.

BACKGROUND OF THE INVENTION

Tabular silver halide grains are well-known for practical use since the early eighties: if present in one or more light-sensitive hydrophilic layers of a silver halide photographic material a high covering power can be expected, even for forehardened silver halide photographic materials as e.g. disclosed in U.S. Pat. No. 3,414,304.

As rapid processing in ecologically justified circumstances is becoming more and more desirable materials having hydrophilic layers containing tabular grains in processing solutions free from hardening agents as have e.g. been proposed in U.S. Pat. No. 5,318,881. With respect to rapid processing ability tabular grains rich in silver chloride are more preferred than tabular grains rich in silver bromide. As has been shown in EP-A 0 678 772 tabular grains rich in silver chloride can provide a high sensitivity in silver halide photographic materials coated from such emulsions. Even in a total processing time of up to 50 seconds with low regeneration amounts of hardener-free processing solutions suitable images are obtained without leaving dye stain, generated from huge amounts of spectral sensitizer. Moreover a suitable black image tone is attained.

In the processing of silver halide photographic materials having tabular grains rich in silver bromide the presence in the developer and in the developer replenisher of bromide ions as a developer restrainer leads to an optimised relationship between fog level, speed and covering power. However in the processing of silver halide photographic materials having tabular grains rich in silver chloride, bromide ions in the developer act as a developer restrainer too, leading to an optimized relationship between fog level and speed, but to an insufficient covering power, wherein said covering power is expressed as density per gram of developed silver. Although covering power is higher in the absence of bromide ions, an increased fog level simultaneously appears which is disadvantageous with respect to sensitometric characteristics and image quality of the processed material.

Loss of the said advantages is not appreciated as higher coating amounts of silver are required in order to get the same maximum density. Such measure is clearly disadvantageous with respect to ecology (more chemical waste after processing) and rapid processing (longer processing times), especially in radiographic applications where high speed, high image quality, rapid processing and ecology become ever more important for the customer.

OBJECTS OF THE INVENTION

It is an object of the present invention to provide a black-and-white developer solution in order to have a method for processing a silver halide photographic material having tabular grains rich in silver chloride, offering after processing an optimized fog-speed relationship, related therewith a high image quality, and, particularly, a sufficiently high covering power.

More specifically it is an object of the present invention to provide a rapid processing method in processing solutions free from hardening agents for the said black-and-white photographic materials without loss of the advantages mentioned above.

SUMMARY OF THE INVENTION

Therefore a method has been found of processing an image-wise exposed black-and-white light-sensitive silver halide photographic material comprising a support coated on one or both sides thereof with hydrophilic layers, wherein at least one of said layers comprises one or more emulsions having tabular silver halide crystals rich in silver chloride, said method comprising the steps of developing, fixing, rinsing and drying, further characterised in that said developing step proceeds in a black-and-white developer comprising one or more organic compounds inhibiting development, more preferably one or more benzotriazole compounds, and in that said black-and-white developer is substantially free from bromide ions.

DETAILED DESCRIPTION OF THE INVENTION

In developer compositions in general organic compounds as benzotriazoles, nitroindazoles and mercaptotetrazoles are known for years to act as developing inhibiting agents having an anti-fogging influence on the image-forming process.

As already set forth in the background of the present invention bromide ions present in the developer and in the developer replenisher are well-know as a developer restrainer.

Developer compositions combining benzotriazoles and bromide ions are well-known from the patent literature as e.g. from EP-A 0 428 455, wherein in the black-and-white developer benzotriazoles are present in an amount of from 0.1–0.3 g/l and wherein sodium bromide is present in an amount of from 1 to 4 g in order to develop the forehardened radiographic materials used therein.

Said compounds are also used in the development of e.g. black-and-white materials comprising cubic grains spectrally sensitized in the red wavelength region as described in U.S. Pat. No. 5,464,730, wherein the developer has a specified low bromide concentration of 0.01 mol/l or less and a pH of 9.8 or less, permitting stable processing of the silver halide material for a long period of time with only little variation of photographic properties of the processed material, although amounts of replenisher are reduced to less than 200 ml per $m^2$. In that reference it has been said that the developer may contain substantially no bromide ions.

A black-and-white developer wherein no bromide ions and organic antifoggant and film speed restrainers have been described is given in U.S. Pat. No. 4,046,571 wherein an improved developer-replenisher system for development of exposed silver halide photographic materials thereby leading to less sensitometric changes for radiographic materials is obtained.

According to the method of the present invention in the processing of tabular silver halide grains rich in silver chloride benzotriazole compounds are preferred organic compounds inhibiting development for use in the black-and-white developer composition of the present invention wherein no bromide ions are present. Preferred benzotriazole compounds have a structure corresponding with the general formula (I),

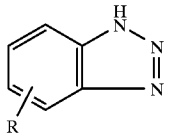

wherein R represents a hydrogen atom, a halogen, an alkyl group, an amino group, a hydroxy group, a carboxy group, a sulphonic acid group, an alkoxycarbonyl group, an acylamide group or a sulfonamide group.

More specifically preferred benzotriazole compounds present in the developer used in the method of the present invention are selected from the group consisting of benzotriazole (I.1), 5-methylbenzotriazole (I.2), 4-methylbenzotriazole (I.3), 6-aminobenzotriazole (I.4), 5-chlorobenzotriazole (I.5), 5-carboxy-benzotriazole (I.6) and 5-trifluoromethyl-benzotriazole (I.7), the formulae of which are given hereinafter. Other useful benzotriazoles are 5-bromobenzotriazole and 5-butyl-benzotriazole. 5-methylbenzotriazole is particularly preferred.

5-methylbenzotriazole is particularly preferred.

(I.1)

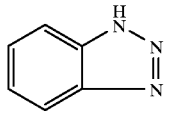

(I.2)

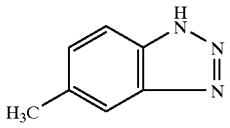

(I.3)

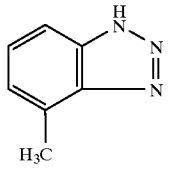

(I.4)

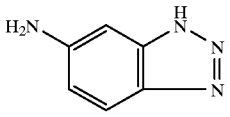

(I.5)

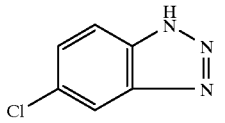

(I.6)

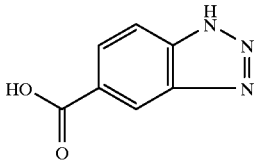

-continued (I.7)

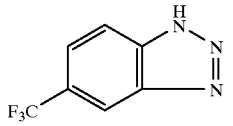

According to the method of the present invention a decrease of fog and an increase of speed occurs in the absence of bromide ions if the benzotriazole compound(s) is(are) added to a certain extent in order to get the highest covering power. Preferred amounts of benzotriazole compounds are in the range of from 0.1 mmole up to 1 mmole per litre of developer ready-for-use.

In a preferred embodiment the black-and-white developer used in the method of the present invention moreover comprises thiocyanate ions in an amount of from 5 mmoles up to 25 mmoles per litre of developer ready-for-use, wherein the presence of other silver complexing ions or silver solvent(s) is not excluded.

In a further preferred embodiment said black-and-white developer comprises developing agents selected from the group consisting of hydroquinone, ascorbic acid, reductic acid or derivatives thereof. As ascorbic acids for the black-and-white developer used in the method of the present invention, an enediol type ascorbic acid, an enaminol type ascorbic acid, an endiamin type ascorbic acid, a thioenol type ascorbic acid, and an enamin-thiol type ascorbic acid may be used. These compounds are e.g. described in U.S. Pat. No. 2,688,549 and in JP-A 62–237443, etc.. Ascorbic acids used in the present invention can be used as the form of the alkali metal salts such as lithium salts, sodium salts, potassium salts, etc.. Ascorbic acid is used for the developer in the amount of generally from 1 to 100 g, and preferably from 5 to 80 g per liter of the developer. Instead of or partially substituting (e.g. in a ratio by weight of from 1:1 up to 9:1) the ecologically questionable "hydroquinone" (iso) ascorbic acid, 1-ascorbic acid and tetramethyl reductic acid are preferred as main developing agent in the developer. Said developing agents have been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented.

The developer for use in the present invention further doesn't contain a development inhibitor such as potassium bromide as is one of the essential characteristics of the black-and-white developer used in the method of this invention. Potassium iodide however may be used in minor amounts of from about 10 to 100 mg per litre of developer as in those amounts it merely acts as a developing activator.

Furthermore the developer may contain a surface active agent, a hard-water softener etc.. So the developer commonly contains a chelating agent. Examples of the particularly preferred chelating agent are diethylenetriaminepentaacetic acid, triethylenetetraaminehexaacetic acid, 1,3-diaminopropanol tetraacetic acid, glycol ether diaminetetraacetic acid, hydroxyethylethylenediaminetriacetic acid, 2-phosphonobutane-1,2,4-tricarboxylic acid, 1,1-diphosphonoethane-2-carboxylic acid, nitritotrimethylenephosphoric acid, ethylenediaminetetraphosphonic acid, diethylenetriaminepentaphosphonic acid, 1-hydroxypropylidene-1,1-diphosphonic acid, 1-aminoethylidene-1,1-diphosphonic acid, 1-hydroxyethylidene-1,1-diphosphonic acid, and the salts of them, without however being limited thereto.

It is particularly preferred to use a 1-phenyl-3-pyrazolidone or, depending on the type of photographic material, a p-aminophenol together with ascorbic acid and/or hydroquinone derivatives. As the 3-pyrazolidone series developing agent being used in the present invention, there are 1-phenyl-3-pyrazolidone, 1-phenyl-4,4'-dimethyl-3-pyrazolidone, 1-phenyl-4-methyl-4-hydroxymethyl-3-pyrazolidone, 1-phenyl-4,4'-dihydroxymethyl-3-pyrazolidone, 1-phenyl-5-methyl-3-pyrazolidone, 1-p-aminophenyl-4,4'-dimethyl-3-pyrazolidone, 1-p-tolyl-4,4-dimethyl-3-pyrazolidone, 1-p-tolyl-4-methyl-4-hydroxymethyl-3-pyrazolidone, etc..

The 3-pyrazolidone series developing agent is preferably used in an amount of from 0.001 mole/liter to 1.2 moles/liter. As the p-aminophenol series developing agent being used in the present invention, there are N-methyl-p-aminophenol, p-aminophenol, N-(β-hydroxyethyl)-p-aminophenol, N-(4-hydroxyphenyl-glycine, 2-methyl-p-aminophenol, p-benzylaminophenol, etc.. A developing agent as N-methyl-p-aminophenol is particularly preferred.

Preferred pH values of the developer used in the method of the present invention are from 8.5 up to 10.3. Alkaline agents which can be used for adjusting pH of the black-and-white developer include a pH controlling agent such as sodium hydroxide, potassium hydroxide, sodium carbonate, potassium carbonate, sodium tertiary phosphate, potassium tertiary phosphate, etc.

As useful sulphite preservative for the black-and-white developer in the present invention, there are sodium sulphite, potassium sulphite, lithium sulphite, ammonium sulphite, sodium bisulphite, potassium metabisulphite, etc.. The amount of the sulphite is generally at least 0.01 mole/liter, and preferably at last 0.02 mole/liter. Also, the upper limit of the amount of the sulphite is preferably 2.5 moles/liter.

In order to reduce "sludge formation" which is favoured by solubilizing agents like sulphites, present in the developer as preservative, a particularly suitable developer solution is the one comprising a reduced amount of sulphite, and in a preferred embodiment even no sulphite, and instead thereof ascorbic acid which acts as a main developer and anti-oxidant as well. Such a composition is called a "low-sludge" developer.

It is further preferred that the black-and-white developer is substantially free from hardening agents (free from the commonly used glutaric dialdehyde as dialdehyde hardener) and still more preferred is that the said fixing step further proceeds in a fixer which is substantially free from aluminum ions, in order to have a processing cycle wherein no hardener is present in the processing solutions.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described e.g. in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odourless. The presence of a-ketocarboxylic acid compounds may be useful as described in EP-A's 0 620 483, 0 726 491 and in RD 16768, published March 1978.

It is possible to use sodium thiosulphate as a fixing agent, thus avoiding the ecologically undesired ammonium ions normally used. For low coating amounts of emulsion crystals rich in chloride a fixation time which is reduced to about 2 to 10 seconds can be attained.

Replenishing of the processing solutions used in the processing method of the present invention in the developing and/or fixing step proceeds with replenishing amounts of 200 ml or less per $m^2$ of the said silver halide photographic material and more preferably in amounts of from 50 up to 150 ml/$m^2$. Preferred minimum regeneration or replenishment amounts are from 20 to 100 ml/$m^2$, more preferred from 25 to 75 ml/$m^2$ and still more preferred from 25 to 50 ml/$m^2$ of developed material. The developer solution used in the method according to the present invention should be replenished not only for decrease of the liquid volume due to cross-over into the next processing solution but also for pH-changes due to oxidation of the developer molecules. This can be done on a regular time interval basis or on the basis of the amount of processed black-and-white film material or on a combination of both. Moreover regeneration is kept to a minimum as set forth hereinbefore, especially in the processing of materials coated from very low amounts of tabular silver halide crystals rich in silver chloride.

Replenishment of a black-and-white developer comprising ascorbic acid or derivatives thereof and a 3-pyrazolidone derivative has been described in EP-A 0 573 700, wherein a method is disclosed for processing with constant activity image-wise exposed silver halide photographic material comprising the steps of (a) developing photographic material in a continuous automatic way by means of a developing solution containing an ascorbic acid analogue or derivative and a 3-pyrazolidone derivative as developing agents; (b) replenishing said developing solution by means of at least one replenishing solution having a higher pH than the developing solution. In an alternative method the replenisher is added as a powder. Other references related therewith are EP-A 0 552 511 and U.S. Pat. No. 5,503,965 and further EP-A 0 660 175, wherein a method of replenishment control has been described.

According to the method of the present invention the processing proceeds within a total processing time of 90 seconds or less and more preferred in a time of from 30 to 60 seconds.

Hydrophilic colloid layers may comprise as hydrophilic colloids proteins such as gelatin derivatives, graft polymers of gelatin and other polymers, albumin, casein, etc.; cellulose derivatives such as hydroxyethyl cellulose, carboxymethyl cellulose, cellulose sulphuric acid esters, etc.; saccharose derivatives such as sodium alginate, dextran, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc., can be used. As gelatin, in addition to lime-processed gelatin, acid-processed gelatin or enzyme-processed gelatin may be used and also, the hydrolysed products or enzyme-decomposition products of gelatin can be used. In these binders dextran having an average molecular weight of not more than 50,000 or polyacrylamide together with gelatin may be used.

In order to reach a high hardening degree the layer binder should of course dispose of an acceptably high number of functional groups, which by reaction with an appropriate hardening agent can provide a sufficiently resistant layer. Such functional groups are especially the amino groups, but also carboxylic groups, hydroxy groups, and active methylene groups.

The silver halide photographic emulsions and light-insensitive hydrophilic colloid layers present in the materials processed according to the method of the present invention may contain an inorganic or organic hardening agent. As hardening agents, chromium salts (e.g., chromium alum and chromium acetate), aldehydes (e.g., formaldehyde, glyoxal, and glutaraldehyde), N-methylol compounds (e.g., dimethylolurea and methylol dimethylhydrantoin), dioxane derivatives (e.g., 2,3-bihydroxydioxane), active vinyl compounds (e.g., 1,3,5-triacryloyl-hexahydro-s-triazine, bis (vinylsulfonyl)methyl ether, and N,N'-methylenebis[β-(vinylsulfonyl)propionamide), active halogen compounds (e.g. mucochloric acid and mucophenoxychloric acid), isooxazoles, dialdehyde starch, and 2-chloro-6-hydroxytriazinylated gelatin can be used alone or as a combination of them. Formaldehyde and phloroglucinol can e.g. be added respectively to the protective layer(s) and to the emulsion layer(s). In these hardening agents, the active vinyl compounds described in JP-A's 53-41221, 53-57257, 59-162546 and 60-80846 and the active halogen compounds described in U.S. Pat. No. 3,325,287 are preferred.

In the method of the present invention the light-sensitive black-and-white silver halide photographic material to be processed comprises a support coated on one or both sides thereof with hydrophilic layers, wherein at least one of said layers comprises one or more emulsions having tabular silver halide crystals rich in silver chloride.

Tabular grains having tabular crystals rich in chloride for use in one or more hydrophilic emulsion layer(s) of silver halide photographic materials can be bound by {111} or {100} major faces.

Tabular silver halide grains having a {111} crystal habit promoted since 1982 as applicable in photographic materials for practical use are defined as crystals possessing two parallel faces with a ratio between the diameter of a circle having the same area as these faces, and the thickness, being the distance between the two major faces, equal to at least 2. Emulsions with crystals rich in chloride were commonly directed to applications in the field of less sensitive materials as e.g. graphic arts materials, duplicating materials, radiographic hard-copy materials, diffusion transfer reversal materials and black-and-white or colour print materials are well-known. The advantages of said emulsions with crystals rich in chloride regarding higher development and fixing rates, are however highly appreciated. As nowadays the tendency is present to get materials processed in shorter processing times, it is highly appreciated to combine said advantages with a high sensitivity for application in high-sensitive materials, an object which can be realized as has e.g. been described in EP-A 0 678 772, which is incorporated herein by reference.

Tabular silver halide grains rich in chloride, bounded by {111} major faces and/or the preparation method thereof and/or materials in which said grains are incorporated have also been described in e.g. U.S. Pat. Nos. 4,399,215; 4,400,463; 4,804,621; 5,061,617; 5,275,930; 5,286,621; 5,292,632; 5,310,644; 5,320,938; 5,356,764; in the published EP-A's 0 503 700, 0 533 189, 0 647 877 and 0 678 772.

Compounds that are useful as crystal habit modifier of crystals rich in silver chloride besides the most frequently used adenine, include substances disclosed in EP-A's 0 481 133 and 0 532 801 and in U.S. Pat. Nos. 5,176,991; 5,176,992; 5,178,997; 5,178,998; 5,183,732; 5,185,239; 5,217,858; 5,221,602; 5,252,452; 5,264,337; 5,272,052; 5,298,385; 5,298,387; 5,298,388; 5,399,478; 5,405,738; 5,411,852 and 5,418,125.

In thin tabular silver chloride, silver chlorobromide, silver chlorobromoiodide or silver chloroiodide emulsions comprising iodide in an amount of from 0.1 mole % up to 3 mole % if iodide is present, the halide distribution in the tabular grains can be homogenous over the whole crystal volume. When phases differing in silver halide composition are present over the crystal volume said crystal is said to have a core-shell structure. More than one shell can be present and between different phases it may be recommended to have a phase enriched in silver iodide by applying the so-called conversion technique during preparation. Iodide ions can be provided by using aqueous solutions of inorganic salts thereof as e.g. potassium iodide, sodium iodide or ammonium iodide. Iodide ions can also be provided by organic compounds releasing iodide ions as has e.g. been described in EP-A's 0 561 415, 0 563 701, 0 563 708, 0 649 052 and 0 651 284 and in WO 96/13759. Especially in order to obtain a more homogeneous iodide distribution in the crystal lattice and over the whole crystal population iodide ions provided by organic agents releasing iodide ions are preferred such as mono iodide acetic acid, mono iodide propionic acid, mono iodide ethanol and even hydrogels containing iodide ions, capable to generate iodide ions.

Although preferred with respect to intrinsic and to spectral sensitivity it is recommended to limit average iodide concentrations to up to 3 mole % and even more preferably to limit them from 0.1 mole % to 1.0 mole %, based on the total silver amount as higher concentrations retard development and lead to unsatisfactory sensitivities. Moreover the velocity of fixation can be disturbed in that case and as a consequence residual colouration may be unavoidable.

In a preferred embodiment the black-and-white silver halide photographic material to be processed according to the method of the present invention comprises tabular silver halide grains rich in chloride which are {111} tabular grains accounting for at least 50% of the total projected area of all grains, having an average aspect ratio of more than 2 and an average grain thickness of from 0.05 up to 0.30 μm. More preferably said silver halide grains rich in chloride are selected from the group consisting of chloride, chloroiodide, chlorobromide or chlorobromoiodide.

Bromide ion concentrations of up to 25 mole % based on the total silver amounts are contemplated, but in order to avoid a strong inhibition of the processing, the tabular silver chlorobromoiodide emulsion crystals used according to the present invention preferably have an amount of silver bromide of at most 10 mole %. In order to reduce the amount of replenisher in the processing, it is even more preferable to reduce the amount of bromide ions to less then 5 mole %. Bromide ions can be provided from at least one inorganic and/or organic agent providing bromide ions.

Emulsions comprising silver chlorobromoiodide or chloroiodide tabular crystals may be built up so that an amount of 20 to 100 mole %, and even an amount of 50 to 100 mole % of the total amount of iodide ions is located at the surface of the said emulsion crystals as e.g. in EP-A 0 678 772 cited hereinbefore. Iodide ions can be present in one or more shell regions, in form of zones wherein iodide ions are concentrated locally.

Distributions of silver halide crystals rich in chloride over the whole population of a silver halide emulsion may be homogenous or heterogenous, depending on the precipitation methods used.

Tabular silver halide grains rich in chloride, bounded by {100} major faces are however not excluded and may be present in one or more hydrophilic light-sensitive silver halide layers of black-and-white photographic materials which are processed according to the method of the present invention. The preparation method of such tabular grains rich in chloride bounded by {100} major faces and/or materials in which said grains can be incorporated have been described in e.g. U.S. Pat. Nos. 5,024,931; 5,264,337; 5,275,930; 5,292,632; 5,310,635; 5,314,798; 5,320,938; 5,356,764 and in WO 94/022051; in the published EP-A's 0 534 395, 0 569 971, 0 584 815, 0 584 644, 0 602 878, 0 616 255, 0 617 317, 0 617 320, 0 617 321, 0 617 325, 0 618 492 and in EP-A 0 653 669. The said {100} tabular grains rich in silver chloride, although been developed later than corresponding {111} tabular grains are the subject of intensive studies as no crystal habit modifier is required in their preparation: {100} tabular grains have a more stable crystal habit than {111} tabular grains rich in chloride.

For practical use thin tabular grains accounting for at least 50% of the total projective surface area of all grains, more preferred for at least 70% and still more preferred for at least 90%, may be present, said grains having an average crystal diameter of from 0.3 to 3.0 μm, more preferred from 0.5 to 2.5 μm and still more preferred from 0.5 to 1.5 μm, for an average thickness of the tabular grain from 0.05 up to 0.30 μm, more preferred from 0.05 to 0.25 μm and still more preferred from 0.06 to 0.20 μm. Average aspect ratios of the tabular grains obtained after calculation from the ratio of diameter to thickness measured for each grain can be in the range 2:1 to 100:1, more preferred from 5:1 to 50:1 and still more preferred from 5:1 to 20:1 or even from 8:1 to 20:1.

Preferred boundary values of grain thickness mentioned hereinbefore are related with the fact that particularly the requirement of high sensitivity and the particular advantages of spectrally sensitized tabular grains should be combined.

For radiographic applications photographic advantages of tabular grains compared to normal globular grains are a high covering power at high forehardening levels, a high developability and higher sharpness thanks to a reduced degree of cross-over, especially in double side coated spectrally sensitised materials. The thinner the tabular grains the greater these advantages: preferred are therefore thicknesses of less than 0.20 μm and more preferred from 0.05 up to 0.15 μm. Moreover preferred tabularities (ratio of aspect ratio and grain thickness expressed in mm) of at least 40 are highly appreciated as such high values are decisive for the high spectral sensitivity of the emulsion grains which strongly depends on its specific surface area.

Said tabular grains rich in chloride may further be doped with whatever a dope as e.g. with group VIII metal ions like $Rh^{+}$, $Ir^{4+}$, $Ru^{2+}$ and $Co^{2+}$ or with $Cd^{2+}$, $Zn^{2+}$ or $Pb^{2+}$ or even with a mixture thereof. Other suitable dopants used during precipitation or chemical ripening of the silver chloride or silver chlorobromide emulsion crystals may be e.g. Fe, Ni, Ru, Rh, Pd, Os, Pt, Hg, Tl and Au. Most preferred are ruthenium, rhodium and iridium. Combinations of one or more dopant(s) may be added, in the same or different preparation steps of silver halide crystals rich in silver chloride having a tabular crystal habit. Just as halide ions the said dopants can be divided homogeneously or heterogeneously over the total crystal volume. So in the core or in the shell or even at the crystal surface, as is e.g. the case when conversion techniques are applied, the said halide ions and/or the said dopants may be concentrated.

An important factor influencing growth of silver nuclei in the preparation of silver halide grains rich in chloride, is the choice of and the amount of protective colloid present in the reaction vessel or added simultaneously with one of the solutions added thereto during nucleation and further, eventually, after nucleation, during physical ripening before and/or during growth of the nuclei formed.

The most well-known and practically used hydrophilic colloidal binder during precipitation of silver halide crystals rich in silver chloride is gelatin. Gelatin may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents, by grafting of polymerizable monomers on gelatin or prehardened gelatins with blocked functional groups as a consequence of this prehardening treatment, cellulose derivatives such as hydroxyalkyl cellulose, carboxymethyl cellulose, phthaloyl cellulose, and cellulose sulphates and even potato starch.

Further synthetic high molecular compounds described in JP-B-52-16365, Journal of The Society of Photographic Science and Technology of Japan, Vol. 29(1), 17, 22(1966), ibid., Vol. 30(1), 10, 19(1967), ibid., Vol. 30(2), 17(1967), and ibid., Vol. 33(3), 24(1967) may be used as a dispersion medium. Also the crystal habit restraining agent described in EP-A 0 534 395 may be used.

Part of gelatin may further be replaced with a synthetic or natural high-molecular material.

In the nucleation step, gelatin having a lower methionine content is often used in the preparation of tabular {111} silver halide crystals rich in chloride. The most preferred gelatin used has a methionine content of from 1 to 60 μmole/g depending on each specific case. More preferably gelatin having a methionine content of from 1 to 50 μmole/g, and still more preferably amounts from 1 to 30 μmole/g (4400 p.p.m.) may be preferably used: according to U.S. Pat. No. 4,713,323, oxidized gelatin is defined as a gelatin having a methionine content of less than 30 μmole/g.

Another factor which may be important in the nucleation and/or grain growth mechanism of {111} tabular grains rich in chloride is the calcium content of gelatin used as a colloidal binder. In most commercial high-quality inert gelatins the calcium content is about 0.4%, which corresponds with about 100 mmole/kg, measured at the end of the preparation process of inert gelatin. Complex-bound calcium ions strongly decrease the electric potential carried by gelatin. Substantially "calcium free gelatin" is thus defined as gelatin with a calcium content at a level below 40 ppm which corresponds with the analytical detection limit.

In a preferred mode the precipitation reaction of the tabular silver chloride, silver chlorobromoiodide and/or silver chloroiodide emulsion crystals proceeds in a dispersing medium wherein the ratio by weight of gelatin to an equivalent amount of silver nitrate is up to 0.35, unless e.g. colloidal silica is used in order to replace gelatin partially or totally. It is clear that this condition will be not fullfilled either when use is made in the reaction vessel, in part or integrally of a non-aqueous medium, of a non-aqeous solvent instead of water, as has been disclosed e.g. in U.S. Pat. Nos. 5,478,718 and 5,541,051.

At the end of the precipitation, following all possible physical ripening steps, the emulsion mixture is normally cooled to about 40° C., before or after adding a flocculate being a polymeric compound as e.g. polystyrene sulphonic acid, providing as a anionic polymer a behaviour depending on pH. Under carefully controlled conditions of addition and stirring rate the pH of the said dispersing medium is adjusted with an acid to a value in order to get a qualitatively good flocculate. Said flocculate may become decanted and washed with demineralized water in order to remove the soluble salts and the development inhibiting crystal habit modifier, as e.g. adenine, to an allowable residual amount (preferably at most 0.3 mg/g of gelatin) or applying an ultrafiltration washing procedure as disclosed e.g. in Research Disclosure, Vol. 102, October 1972, Item 10208, Research Disclosure Vol. 131, March, Item 13122 and Mignot U.S. Pat. No. 4,334,012.

Said ultrafiltration technique may be applied on-line during the whole precipitation, in order to reduce the increasing amount of water, thus avoiding dilution of the reaction vessel and increasing amounts of soluble salts like the mainly occurring potassium nitrate. Examples thereof have been described e.g. in EP-A 0 577 886. When the emulsion after precipitation is washed by diafiltration by means of a semipermeable membrane, a technique also called ultrafiltration, it is not necessary to use polymeric flocculating agents that may disturb the coating composition stability before, during or after the coating procedure. Such procedures are disclosed e.g. in Research Disclosure Vol. 102, October 1972, Item 10208, Research Disclosure Vol. 131, March, Item 13122 and U.S. Pat. No. 4,334,012. Preferably, at the start of the ultrafiltration, there is no pH or pAg adjustment as pH and pAg are the same as at the end of the preceding precipitation without any adjustment step. Moreover ultrafiltration may be proceeded in order to get the desired pH and pAg values, required when performing further treatment steps as e.g. addition to coating solutions. Any washing step may further be performed by means of halide containing water, preferably water containing chloride ions.

Redispersion, if required, may further be performed by addition of extra hydrophilic colloid. As a consequence values of gesi and/or sisi (defined as ratio by weight of silica (if present) to silver, said silver being expressed as equivalent amount of silver nitrate) may be enhanced up to values desired in order to prepare stable coating solutions as will be clear from the description following hereinafter. It is clear however that any useful protective colloid cited hereinbefore as an alternative of gelatin or gelatin in modified form may be used.

The presence of iodide ions at the surface of silver chloroiodide or silver chlorobromoiodide tabular crystals already set forth hereinbefore is not only preferred from the viewpoint of crystal habit stability but particularly preferred as upon spectral sensitization an improved adsorption of the spectral sensitizer and an improved light absorption is obtained and as the quantum efficiency detected in the photochemical processes is increased.

As a consequence a more easy spectral sensitization may be expected due to an easy formation of e.g. J-aggregates, and/or to the addition of higher amounts of spectral sensitizer(s) due to the presence of an enhanced specific surface of the tabular crystals, resulting in better photographic characteristics. Useful methine dyes such as those described by F. M. Hamer in "The Cyanine Dyes and Related Compounds", 1964, John Wiley & Sons include cyanine dyes, merocyanine dyes, complex cyanine dyes, complex merocyanine dyes, holopolar cyanine dyes, hemicyanine dyes, styryl dyes and hemioxonol dyes. Particularly valuable dyes are those belonging to the cyanine dyes, merocyanine dyes, complex merocyanine dyes. Examples of selected useful green light absorbing spectral sensitisers are e.g. anhydro-5,5'-dichloro-3,3'-bis(n-sulphobutyl)-9-ethyloxacarbocyanine hydroxide or anhydro-5,5'-dichloro-3,3'-bis(n-sulphopropyl)-9-ethyl-oxacarbocyanine hydroxide. A suitable mixture of spectral sensitizers that is applied is anhydro-5,5'-dichloro-3,3'-bis(n-sulphobutyl)- 9-ethyl oxacarbocyanine hydroxide or anhydro-5,5'-dichloro-3,3'-bis(n-sulphopropyl)-9-ethyloxacarbocyanine hydroxide together with anhydro-5,5'-dicyano-1,1'-diethyl-3,3'-di(2-acetoxy-ethyl)ethyl-imidacarbocyanine bromide. Specific combinations of imidacarbocyanines and oxacarbocyanines as spectral sensitizers added to emulsions prior to chemical sensitization have been described in EP-A 0 608 955. Unsymmetrically chain substituted oxacarbocyanine dyes and/or imidacarbocyanine dyes to improve e.g. dye stain after processing and spectral sensitivity in the green short wavelength region have been given in JP-A 03–048235. Supersensitization with a symmetrical oxacarbocyanine dye in combination with a carbocyanine dye of e.g. the oxazole-imidazole type has been disclosed in U.S. Pat. Nos. 4,594,317 and 4,659,654. Specifically spectral sensitization of tabular grains with N-fluoroalkyl substituted imidacarbocyanine dyes has been described in U.S. Pat. No. 4,675,279.

Dyes absorbing in the blue wavelength region of the visible spectrum for use as spectral sensitizers for cubic and/or tabular silver halide grains rich in chloride have been described in JP-A 01-196031 and in U.S. Pat. Nos. 4,494,212; 4,952,491 and 5,376,523. As is well-known and as has been described in U.S. Pat. Nos. 5,108,887 and 5,376,523 and in EP-A's 0 622 665 and 0 712 034, zeromethine dyes are very useful in the said wavelength region.

As already set forth combinations of differing spectral sensitizers may be used as well as mixtures of emulsions being the same or different, wherein each part may be spectrally sensitized with another spectral sensitizer or with another combination of spectral sensitizers. Spectral sensitizers having asymmetrical heterocycles may be useful with respect to improvements in residual colouration after processing.

It is highly contemplated that spectral sensitization can occur simultaneously with or even precede completely the chemical sensitization step.

Other dyes, which do not have any spectral sensitization activity, or certain other compounds, which do not substantially absorb visible radiation, may have a supersensitization effect when they are incorporated together with said spectral sensitizing agents into the emulsion. Suitable supersensitizers are e.g. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products as described e.g. in U.S. Pat. No. 3,743,510, cadmium salts, and azaindene compounds.

Before starting chemical sensitization the surface of the silver halide grains rich in chloride may be treated with slightly oxidizing compounds as e.g. toluene thiosulphonic acid and/or corresponding salts thereof in order to reduce small silver specks to grow to fog centers in an uncontrolled manner.

To silver halide grains rich in chloride chemically sensitizing compounds can be added as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas; selenium e.g. selenosulphate, selenocyanate, selenoureas; tellurium e.g. tellurosulphate, tellurocyanate, telluroureas; sulphites, mercapto compounds, rhodamines etc.. The emulsions can be sensitized also by means of gold-sulphur ripeners, gold-selenium ripeners, gold-sulphur-selenium ripeners, or by means of reductors e.g. tin compounds as described in GB 789,823, amines, hydrazine derivatives, formamidine-sulphinic acids, and silane compounds although care should be taken in order to prevent the emulsion from fog formation in an uncontrollable way.

Normal amounts of gold compounds (as gold chloride or gold thiocyanate) are in the range from $1\times10^{-5}$ to $2.5\times10^{-5}$ moles per mole of silver halide.

As has already been suggested hereinbefore the use of reducing agents in the chemical ripening of silver halide emulsion crystals rich in chloride is not preferred, but not excluded either as depending upon the circumstances it may be recommended to use small amounts in order to counterbalance the restraining actions from spectral sensitizers, fog-restrainers or stabilizers as e.g. substituted heterocyclic mercaptocompounds described in U.S. Pat. No. 5,242,791. Silver solvents may have a regulating role therein as e.g. thiocyanate ions.

The silver halide photographic emulsions being used in the processing method of the present invention can further contain various kinds of compounds in addition to the silver halide adsorptive materials in the chemical sensitization step in the present invention for preventing the occurrence of fog in the production steps, the storage and photographic processing of the photographic materials or stabilizing the photographic performance of the photographic materials.

For example, the silver halide photographic emulsions can contain any of the compounds known as antifoggants or stabilizers such as azoles (e.g., benzothiazolium salts, nitroimidazoles, nitrobenzimidazoles, chlorobenzimidazoles, bromobenzimidazoles, nitroindazoles, benzotriazoles, and aminotriazoles); mercapto compounds (e.g., mercaptothiazoles, mercaptobenzothiazoles, mercaptobenzimidazoles, mercaptothiazoles, mercaptotetrazoles, mercaptopyrimidines, and mercaptotrizines); thioketo compounds (e.g., oxadolinethione); azaindenes (e.g., triazaindenes, tetraazaindenes,in particular, 4-hydroxy-substituted (1,3,3,a,7)tetraazaindenes), and pentaazaindenes; benzenethiosulfonic acid; benzenesulfinic acid; benzenesulfonic acid amide, etc..

In particular, the mercapto compounds described in JP-A 60-80839, the heterocyclic compounds described in JP-A-57-164735, and the complex salts of heterocyclic compounds and silver (as e.g. 1-phenyl-5-mercaptotetrazole silver), etc., can preferably be used. Also, even when a sensitizing dye is used as silver halide adsorptive material in the chemical sensitization step, if necessary, a spectral sensitizing dye for other wavelength region may be added to the emulsion. Therefore compounds preventing the formation of fog or stabilizing the photographic characteristics during the production or storage of the photographic elements or during the photographic treatment thereof are required and are in most cases already present during emulsion precipitation and/or (spectral and/or chemical) sensitization. Many known compounds can be added as fog-inhibiting agent or stabilizer to the silver halide emulsion layer or to other coating layers in water-permeable relationship therewith such as an undercoat or a protective layer. Suitable examples have been described in Research Disclosure No. 17643 (1978), Chapter VI and in RD's Nos. 36544 (1994) and 38957 (1996), Chapter VII.

The photographic element may further comprise various kinds of coating physical property modifying addenda as described in RD's Nos. 36544 (1994) and 38957 (1996), Chapter IX, wherein coating aids, plasticizers and lubricants, antistats and matting agents have been described. Development acceleration can be accomplished for materials which are processed according to the method of the present invention by incorporating in emulsion layer(s) or adjacent layers various compounds, preferably polyalkylene derivatives having a molecular weight of at least 400 such as those described in e.g. U.S. Pat. Nos. 3,038,805; 4,038,075 and 4,292,400 as well as in EP-A's 0 634 688 and 0 674 215.

The photographic element may further comprise various other additives such as e.g. compounds improving the dimensional stability of the photographic element, ultraviolet absorbers and spacing agents. Suitable ultraviolet absorbers have e.g. been described in RD's Nos 36544 (1994) and 38957 (1996), Chapter VI, wherein also suitable optical brighteners are mentioned. Spacing agents may be present of which, in general, the average particle size is comprised between 0.2 and 10 $\mu$m. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

As already set forth additional gelatin or another hydrophilic colloid, suitable as a binder material can be added at a later stage of the emulsion preparation e.g. after washing, in order to establish optimal coating conditions and/or in order to establish the required thickness of the coated emulsion layer. Preferably a gelatin to silver halide ratio, silver halide being expressed as the equivalent amount of silver nitrate, ranging from 0.3 to 1.0 is then obtained. Another binder may also be added instead of or in addition to gelatin. Useful vehicles, vehicle extenders, vehicle-like addenda and vehicle related addenda have been described e.g. in Research Disclosures Nos 36544 (1994) and 38957 (1996), Chapter II.

Prior to coating any thickening agent may be used in order to regulate the viscosity of the coating solution, provided that they do not particularly affect the photographic characteristics of the silver halide light-sensitive photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica.

Polymeric thickeners well-known from the literature resulting in thickening of the coating solution may even be used in combination with colloidal silica. Patents concerning thickening agents are e.g. U.S. Pat. No. 3,167,410; Belgian Patent No. 558.143 and JP-A's 53-18687 and 58-36768. Negative effects on physical stability possibly resulting from the addition of polymeric compounds can be avoided by exclusion of those compounds and by restricting extra additions of colloidal silica. In order to coat hydrophilic colloidal layer compositions on a support by slide-hopper or curtain-coating techniques, wherein said compositions have gelatin in low amounts in order to provide a ratio by weight of gelatin to silver halide expressed as an equivalent amount of silver nitrate in the range from 0.05 to 0.4, thickening agents composed of synthetic clay and anionic macromolecular polyelectrolytes wherein said synthetic clay is present in an amount of at least 85% by weight versus the total amount of thickening agents are recommended as has been disclosed in EP-Application No. 96201653, filed Jun. 13, 1996.

With respect to the ability of coating of extremely thin hydrophilic layers a light-sensitive silver halide photographic material is disclosed in EP-Application No. 96202601, filed Sep. 18, 1996, wherein said material comprises a support and one or more hydrophilic colloidal silver halide emulsion layers having silver halide crystals with colloidal silica as a protective colloid the said layer(s) having a gesi, defined as ratio by weight of gelatin to silver, in the range from 0 to less than 0.05 and a sisi, defined as ratio by weight of silica to silver, in the range from 0.01 to less than 0.10, wherein said weight of silver in the calculation of gesi and sisi is expressed as an equivalent amount of silver nitrate. Photographic material having thin emulsion layers e.g. layers with a layer thickness of less than 5 $\mu$m, containing less than 5 g of gelatin, preferably about 3 g/m$^2$ and more preferably about 2 g/m$^2$ offer the advantage that besides rapid processing applicability and the rapid drying of the wet processed material an improvement in sharpness is observed.

Besides the light-sensitive emulsion layer(s) the black-and-white photographic material may contain several light-insensitive layers at the side of the support carrying said light-sensitive emulsion layer(s), e.g. a protective antistress layer which can be split up into two layers, one of them being an underlying interlayer or an outermost afterlayer coated or sprayed on top of the "basic" protective antistress layer.

In a preferred embodiment according to the method of the present invention said protective antistress layer comprises one or more organic compounds inhibiting development. Said organic compound(s) inhibiting development is(are) preferably (a) benzotriazole compound(s). Moreover said benzotriazole compound(s) preferably has(have) a structure corresponding to the general formula (I) already given hereinbefore. More preferably said compound(s) is(are) selected from the group consisting of benzotriazole, 5-methylbenzotriazole, 4-methylbenzotriazole, 6-aminobenzotriazole, 5-chlorobenzotriazole, 5-carboxybenzotriazole and 5-trifluoromethyl-benzotriazole. In a still more preferred embodiment said organic compounds inhibiting development are present in the protective antistress layer in an amount of from 0.001 mmole up to 0.010 mmole per gram of silver, expressed as an equivalent amount of silver nitrate, coated per square meter of the said material. When the developer is free from sulphite ions, said sulphite ions being replaced by anti-oxidants as e.g. 1-ascorbic acid, reductic acid, erythorbic acid, iso-ascorbic acid, derivatives thereof and/or salts thereof, then a low-sludge developer is provided. Said anti-oxidants, if moreover replacing common developing agents as e.g. hydroquinone lead to a particularly useful ecologically justified low-sludge developer.

When in the fixing step the fixer solution is free from aluminum ions, it is clear that the light-sensitive black-and-white silver halide photographic materials processed according to the method of the present invention should be hardened to such an extent that in a fixation step free from aluminum ions no problems as e.g. sludge formation or troubles with physical properties of the materials occur. A survey of hardening agents available in order to foreharden coated hydrophilic gelatinous layers of the said photographic materials has been given e.g. in Research Disclosure 38957, Chapter IIb. As an alternative aluminum salt solutions as e.g. aluminum sulphate may be spray-coated onto or coated in an afterlayer onto the protective antistress layer or another outermost layer of the photographic material, in favour of hardening of the surface layer and in favour of physical properties obtained for the processed material after fixation in a fixer free from hardening aluminum ions, especially with respect to surface glare, pressure sensitivity and unevenness in the processing.

Besides the protective antistress layer(s) and optional afterlayer(s) as other non-light-sensitive layers one or more subbing layers, one or more intermediate layers e.g. filter layers, antistatic agent(s), filter dyes for safety-light purposes etc. may be present.

Protective antistress layers preferably contain coating aids and coating physical property modifying addenda mentioned in RD's Nos. 36544 and 38957, published September 1994 and 1996 respectively, Chapter IX. Antistatic properties are especially preferred in order to prevent blackening after processing in form of sparks etc. due to abrupt decharging of electrostatic charges during production and/or handling before exposure and/or processing. It is highly preferred to add antistatic agents to the protective antistress layer or to an afterlayer coated thereupon as has been described e.g. in EP-A's 0 534 006, 0 644 454 and 0 644 456 and U.S. Pat. Nos. 4,670,374 and 4,670,376. Abrasion resistance of these outermost layers may be improved as described in U.S. Pat. Nos. 4,766,059 and 4,820,615. Spray-coating of afterlayers has been disclosed e.g. in U.S. Pat. No. 5,443,640. Non-imagewise blackening may alternatively be due to pressure sensitivity of the silver halide grains rich in chloride. Measures in order to prevent pressure sensitivity may be coating of enhanced amounts of binder as e.g. gelatin. This however is disadvantageous with respect to rapid processing and therefore as an alternative silver halide crystals rich in chloride prepared in silica may offer an alternative as has been disclosed e.g. in EP-A 0 528 476. Moreover with respect to the binder material in the light-sensitve emulsion layer an improvement of pressure sensitivity can be expected if use is made therein from synthetic clays as has been disclosed in U.S. Pat. No. 5,478,709. As an alternative zeolites may be used. In the presence however of spectral sensitized emulsion crystals in the said light-sensitive layers care should be taken in order to select suitable synthetic clays as has been disclosed in EP-A 0 757 285.

Intermediate layers eventually containing filter or antihalation dyes that absorb scattering light and thus promote the image sharpness have been described in e.g. U.S. Pat. Nos. 4,092,168; 4,311,787; 5,344,749; 5,380,634; 5,474,881; 5,478,708; 5,502,205; in EP-A's 0 489 973 and 0 586 748 and in EP-A's 0 786 497 and 0 781 816; in DE 2,453,217, and in GB Patent 7,907,440. Situated in such an intermediate layer between the emulsion layers and the support there will be only a small negligable loss in sensitivity but rapid processing conditions, although said dyes decolourize very rapidly in alkaline solutions, require minimization of the thickness of the whole coated layer, an item which has already been discussed hereinbefore: multilayer arrangements of thin layers clearly result in shorter drying times after washing in the processing cycle. It is further in favour of decolourizing properties to have said suitable dyes in form of finely dispersed form and more preferred in solid particle dispersed form. Evidence therefore is specifically given in EP-A 0 724 191 and in a more general way in EP-A 0 756 201.

In addition thereto it is recommended to prepare aqueous solid dispersions in colloidal silica for any photographically useful compound as has been described e.g. in EP-A 0 569 074. Advantages with respect to thin layer coating and rapid processing ability can be expected, without enhancing pressure sensitivity of more vulnerable layers.

Backing layers applied to a material having at least one emulsion layer at one side of a light-sensitive silver halide material having emulsion crystals rich in chloride used in the image-forming systems essentially contain as ingredients hydrophilic colloids, one or more antihalation dye(s), matting agent(s), surfactant(s), antistatic agent(s), lubricant(s) and hardening agent(s), said ingredients being same as discussed hereinbefore. Amounts of hydrophilic colloids may be chosen in order to prevent curl of the single side emulsion coated material, such as in U.S. Pat. No. 5,155,013. Also non-swelling hydrophobic polymers can be used in the backing layer as has e.g. been described in U.S. Pat. No. 5,326,686. Further measures to prevent curling have been disclosed e.g. in JP-A's 02–24645; 02–85847 and 02–87138.

The support of the black-and-white photographic materials comprising silver halide emulsion having crystals rich in chloride, used for X-ray imaging, may be a transparent resin, preferably a blue coloured polyester support like polyethylene terephthalate. The thickness of such organic resin film is preferably about 175 $\mu$m. Other hydrophobic resin supports are well known to those skilled in the art and are made e.g. of polystyrene, polyvinyl chloride, polycarbonate and polyethylene naphthalate. The support is further provided with a substrate layer at both sides to have good adhesion properties between the adjacent layers and said support: one or more subbing layers known to those skilled in the art for adhering thereto a hydrophilic colloid layer may be present. Suitable subbing layers for polyethylene terephthalate supports are described e.g. in U.S. Pat. Nos. 3,397,988, 3,649,336, 4,123,278 and 4,478,907. A preferred layer arrangement wherein a subbing layer composition comprising as a latex copolymer vinylidene chloride, methylacrylate and itaconic acid has been covered with hydrophilic layers being at least one gelatinous dye containing layer comprising one or more dyes, at least one silver halide emulsion layer, at least one protective antistress layer, and optionally an afterlayer has been described in EP-A 0 752 617. In that invention said hydrophilic layers have a swelling ratio of not more than 200% and in said hydrophilic layers are coated simultaneously by the slide-hopper coating or by the slide-hopper curtain coating technique. Further information on suitable supports can be found in RD's Nos. 36544 and 38957, Chapter XV, published September 1994 and September 1996 respectively.

The silver halide grains or the silver halide emulsions in the present invention can be used for conventionally known all black-and-white photographic materials such as, for example, X-ray photographic materials, photographic materials for printing, photographic papers, photographic negative films, microfilms, direct positive photographic materials, super fine grain light-sensitive materials (for a LSI photomask, for a shadow mask, for a liquid crystal mask, for diffusion transfer type materials, for heat-developable photographic materials, for high-density digital recording photographic materials, photographic materials for holography, etc..

In a preferred embodiment black-and-white silver halide photographic materials comprising tabular grains rich in chloride to be processed according to the method of the present invention are (single-side or double-side coated) radiographic materials or (single-side coated) laser-imaging materials wherein a laser source directed by digital information is "written" on a hard-copy laser film. Suitable lasers may be gas lasers or solid state lasers. As a suitable gas laser a helium/neon gas laser is well-known (absorption maximum 633 nm). As a solid state laser an infrared laser diode having a more bathochrome absorption maximum at 820 nm may be used, but nowadays also green- and blue-light laser sources are available, as e.g. a YAG-laser. As a preferred laser imager we refer to the laser imager MATRIX LR 3300, trade name product marketed by Agfa-Gevaert.

Single-side coated materials have e.g. been described in U.S. Pat. No. 5,449,599, in EP-A's 0 610 608, 0 712 036 and 0 794.456. Double-side coated materials have e.g. been described in U.S. Pat. Nos. 5,397,687 and 5,660,966 and in EP-A's 0 678 772 and 0 754 972.

In radiography the interior of objects is reproduced by means of penetrating radiation which is high energy radiation belonging to the class of X-rays, $\gamma$-rays and high energy elementary particle radiation, e.g. $\beta$-rays, electron beam or neutron radiation. For the conversion of penetrating radiation into visible light and/or ultraviolet radiation luminescent substances are used called phosphors. Light emitted imagewise by intensifying screens as in medical diagnosis irradiates a contacting photographic silver halide emulsion layer film which after exposure is developed to form therein a silver image in conformity with the X-ray image.

More specifically for use in common medical radiography the X-ray film comprises a transparent film support double-side coated with a silver halide emulsion layer. During the X-ray irradiation said film is arranged in a cassette between two X-ray conversion screens each of them making contact with their corresponding silver halide emulsion layer. Phosphors suitable for use in the conventional radiographic system must have a high prompt emission on X-ray irradiation and low after-glow in favour of image-sharpness.

An improved set of blue-light-emitting screens has e.g. been described in U.S. Pat. No. 5,381,015. Specific intensifying screens emitting ultraviolet-blue radiation have further been disclosed in U.S. Pat. Nos. 4,225,653; 4,387,141; 4,710,637; 5,112,700; 5,173,611 and 5,432,351; in EP-A's 0 650 089; 0 658 613; in WO93011457 and WO95015514.

Typical blue-UV emitting phosphors are tantalates and hafniates and fluorohalides of barium and strontium. In EP-Application No. 96202050, filed Jul. 19, 1996, particles a niobium doped, monoclinic M, yttriumtantalate phosphor and particles of an europium doped bariumfluorohalide phosphor are composing the screen.

Specific intensifying screens emitting green light radiation have been disclosed in GB 1 489 398; in U.S. Pat. Nos. 4,431,922 and 4,710,637. A typical green emitting phosphor used therein is a gadolinium oxisulphide phosphor.

Screen-film systems wherein blue and/or (ultra)violet radiation emitted by screens is absorbed by suitable films in contact therewith have been described e.g. in EP-A 0 712 034 and in EP-Application 97202169, filed Jul. 11, 1997, and in WO93001521. In the said WO a double-side coated element is disclosed containing at least 50% of tabular grains having at least 50 mole % of chloride.

Screen-film systems wherein green-light emitting screens are used in contact with green sensitized silver halide films have been described e.g. in EP-A 0 678 772.

Screen/film combinations may be symmetric or asymmetric: this means that screens differing in speed and/or radiation emitted therefrom are differing and/or that there is a difference in speed and/or contrast and/or spectral sensitivity at both sides of the film support.

Although it is possible to use whatever a processing unit adapted to the requirements described hereinbefore to reach the objectives concerning a perfect link between rapid processing and ecology, the objects of this invention concerning processing have e.g. been realised in the processing unit CURIX HT 330, trade name product marketed by Agfa-Gevaert.

New developments however become available with respect to processing apparatus. In a conventional processing apparatus the sheet material is transported along a generally horizontal feed path, the sheet material passing from one vessel to another usually via a circuitous feed path passing under the surface of each treatment liquid and over dividing walls between the vessels. However, processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus. In a vertically oriented apparatus, it is important to avoid, or at least minimise leakage of treatment liquid from one vessel to another and carry-over as the sheet material passes through the apparatus. Furthermore it is desirable that the treatment liquid in one vessel is not contaminated by contents of the adjacent vessels, that is neither by the treatment liquid of the next higher vessel nor by vapours escaping from the next lower vessel. In order to reduce consumption of treatment liquids, it is furthermore desirable to reduce the evaporation, oxidation and carbonization thereof.

A solution therefore has been proposed in U.S. Pat. No. 5,652,939, wherein it has been disclosed that contamination and evaporation, oxidation and carbonization can both be reduced in a simple manner by a particular construction of the apparatus for the processing of photographic sheet material comprising a plurality of cells mounted one above the other in a stack to define a substantially vertical sheet material path through the apparatus, each cell comprising a housing within which is mounted a rotatable roller biased towards a reaction surface to define a roller nip therebetween through which the sheet material path extends and associated sealing means serving to provide a gas- and liquid-tight seal between the roller and reaction surface on the one hand and a wall of the housing on the other. According to a first aspect, invention is characterized by means for connecting each cell to adjacent cells in the stack in a closed manner and according to a second aspect, the invention is characterised in that the roller is a drive roller.

Particularly the objectives set forth above may be achieved when the developing cell of the apparatus is a closed cell and the developing liquid contains an ascorbic acid developing agent as has been described in EP-Application No. 96201753, filed Jun. 24, 1996.

According to that invention, there is provided a method of processing photographic sheet material by use of an apparatus comprising a plurality of processing cells so arranged to define a sheet material path through the apparatus, at least one of the cells constituting a developing cell containing a developing liquid, characterised in that the developing cell is a closed cell and the developing liquid contains an ascorbic acid developing agent.

With respect to further characteristics of the processing apparatus we refer to EP-Application No. 96202032, filed Jul. 17, 1996, wherein it was an object to provide an apparatus in which operating components can easily be replaced without the need for substantial re-programming of the CPU (central processing unit).

It is clear that within the scope of the present disclosure any combination of a laser/film or screen(s)/film may be used, wherein said film may comprise {111} and/or {100} tabular silver halide crystals rich in silver chloride in combination with a processing unit as disclosed in that reference, the proviso that with minimum amounts of silver coated a sufficiently high covering power is attained in the film in rapid ecological processing (with e.g. ascorbic acid and/or derivatives thereof as developing agent(s) in a hardener-free developer and an odour-free fixer, optionally free from aluminum ions, thereby reducing sludge; and replenishing amounts for developer and fixer as low as possible) and the proviso that an optimal relationship is attained between sensitometry and image quality, especially sharpness, partly thanks to low cross-over exposure in the case of double-side coated films.

The following examples are intended to illustrate the present invention but not to limit it in any way.

EXAMPLES

Example 1

The following solutions were prepared:

6 l of a dispersion medium (C) containing 480 mmoles of sodium chloride, 150 g of inert gelatin and 360 mg of adenine; temperature was established at 45° C., pH was adjusted to 6.0;

a 2.94 molar silver nitrate solution (A);

a solution containing 2.813 moles of sodium chloride, 14 mmoles of potassium iodide and 398.1 mg of adenin (B1). A nucleation step was performed by introducing solution A and solution B1 simultaneously in dispersion medium C both at a flow rate of 120 ml/min during 30 seconds. After a physical ripening time of 20 min during which the temperature was raised to 70° C., the first growth step was performed by introducing by a double jet during 28 minutes and 50 seconds solution A starting at a flow rate of 10 ml/min and linearly increasing the flow rate to an end value of 27.4 ml/min, and solution B1 at an increasing flow rate in order to maintain a constant mV-value, measured by a silver electrode versus a saturated calomel electrode (S.C.E.), of +115 mV. At the end of the first growth step the flow rate of solution A was immediately decreased to 10 ml/min and the mV-value adjusted to +135 mV and increased again to a flow rate of 19.8 ml/min during the following 16 minutes and 8 seconds, during which time the mV-value was further held constant at +135 mV by a controlled increasing flow of B1. After a physical ripening time of 4 minutes a solution of 40 ml having 15 mmoles of potassium iodide was added at a constant flow rate of 2 minutes.

The total iodide content of the tabular silver chloroiodide crystals was thereby enhanced to a value of up to 1.0 mole %.

After cooling to about 40° C. the addition of 56 ml of polystyrene sulphonic acid in 2 minutes was started, the pH value of the said dispersing medium was adjusted to a value of 3.5 with sulphuric acid and after cooling to 20° C. the obtained flocculate was decanted and washed three times with an amount of 4 l of demineralised water (11° C.) in order to remove the soluble salts present. After decanting to a volume of 2 l the washing procedure was repeated twice and after the last washing step, followed by sedimentation decantation was performed in order to have an emulsion volume as low as possible.

To this dispersion medium an amount of 1.25 mmole per mole of silver chloride was added of the dye anhydro-5,5'-dichloro- 3,3'-bis(n-sulphobutyl)-9-ethyloxacarbocyanine hydroxide.

The thus obtained silver chloride tabular emulsion showed the following grain characteristics:

an average equivalent circular diameter E.C.D. of 0.60 μm;

an average thickness t of 0.085 μm;

an average aspect ratio AR of 7.0.

These data were obtained from electron microscopic photographs: the diameter of the grain was defined as the diameter of the circle having an area equal to the projected area of the grain as viewed in the said photographs.

Before the start of the chemical ripening the mV-value of the emulsion was adjusted at +120 mV with sodium chloride and the pH-value at 5.5 with sodium hydroxide. Chemical ripening agents were adapted to the crystal size of the emulsions.

Chemical ripening agents were gold thiocyanate, sodium thiosulphate as a source of sulphur and toluene thiosulphonic acid was used as predigestion agent. The amounts of each chemical ripening agent were optimized in order to obtain an optimal fog-sensitivity relationship after 2 hours at 57° C.

Before coating each emulsion was stabilized with 1-p-carboxyphenyl-5-mercaptotetrazole and after addition of the normal coating additives the solutions were coated simultaneously together with a protective layer containing 1.3 g gelatine per $m^2$ per side on both sides of a polyethylene terephthalate film support having a thickness of 175 μm.

The resulting black-and-white photographic material contained per side an amount of silver halide corresponding to 3.5 grams of $AgNO_3$ per $m^2$ and an amount of gelatin corresponding to 2.8 g/$m^2$.

Samples of these coatings were exposed with green light of 540 nm during 0.1 seconds using a continuous wedge and were processed during the "90 seconds cycle" described below. The processing occurred in a black-and-white developer, the composition of which has been given hereinafter. The processing was run in the processing machine CURIX 330 (Agfa-Gevaert trade name product) within a total processing time of 60 seconds, developer and fixer being held at 35° C.

As a comparative emulsion an emulsion having cubic silver chloroiodide crystals was prepared having 99.8 mole % of silver chloride and 0.2 mole % of iodide and an average grain size of 0.57 μm. The said cubic crystals were prepared in the following way: an amount of 880 ml of demineralized water was used as starting volume in the vessel, containing further 46 g of inert gelatin at 60° C. 2 ml of a solution of silver nitrate 0.3 molar was added. Two minutes later a sodium chloride 4N was added dropwise in order to adjust UAg to a potential difference vs. a S.C.E. reference electrode of +138±2 mV.

Concentrated solutions of 1 l of $AgNO_3$ and NaCl, 3N each, were run during 5 minutes with the double jet technique at a rate of 3 ml per minute for the silver nitrate solution and the sodium chloride solution. After the said 5 minutes the rate of addition of silver nitrate was linearly increased from 3 to 30 ml/min. during a time of 59 min. 42 sec.. During this time interval the addition rate of the sodium chloride solution was adjusted continously in order to maintain the UAg value at the value adjusted before starting precipitation. After an additional physical ripening time of 5 minutes at the end of the precipitation the flocculation procedure could begin: pH was adjusted at a value of 3.3 with sulphuric acid, 3M, and 4.5 g of polystyrene sulphonic acid was added slowly in 2 minutes. The washing procedure was performed in a discontinous way, adding 3 l of demineralized water, containing up to 8 mmole of sodium chloride per liter. After addition of inert gelatin to a ratio of gelatin to silver nitrate in the emulsion of about 0.5, the emulsion was peptized and was chemically ripened to an optimal fog-sensitivity relationship at 52° C., UAg having a value of about 160 mV. Chemical ripening agents, besides gold (in an amount of 0.019 mmole) and sulphur (tetramethyl thiodithiocarboxylic acid diamide in an amount of 0.061 mmole), were toluene thiosulphonic acid and iodide ions, both being predigestion agents in amounts of 0.02 mmoles and 6 mmoles respectively.

Spectral sensitization was performed in the same way as for the tabular grains. The emulsion having cubic crystals was coated in the same way and with the same coating amount of silver as for the tabular grains.

The processing composition for the black-and-white development of the silver halide crystals rich in chloride is given hereinafter, wherein amounts of potassium bromide and methyl-benzotriazole are variable (indicated as x and y repectively; further expressed in g/l) as will become clear from the experimental data given hereinafter:

| | |
|---|---|
| demineralized water | 700 ml |
| 1-ascorbic acid | 50 g |
| 4,4'-hydroxymethyl-methyl-phenidone | 2 g |
| potassium bromide | x g |
| potassium thiocyanate | 1 g |
| 5-methyl-benzotriazole | y g |
| aqueous potassium sulphite (655 g/l) | 50 ml |
| aqueous potassium carbonate (765 g/l) | 125 ml |
| aoueous potassium hydroxyde (755 g/l) | 10 ml |
| 1-hydroxy ethyl diphosphonic acid di-Na salt | 1 g |
| Polyethylene glycol (M.W.: 400) | 20 ml |
| pH (adjusted with acetic acid) | 9.65 |
| Water to make 1 l. | |

The concentrated black-and-white developer free from hardening agents should be diluted with the same amount of demineralized water (pH of developer ready-for-use: 10.46).

| Composition of the fixer: | |
|---|---|
| ammionium thiosuiphate (60%) | 710 ml |
| boric acid | 20.8 g |
| sodium sulphite | 45 g |
| sodium acetate.3 aq. | 58 g |
| acetic acid | 48.5 ml |
| sulphuric acid | 20 ml |
| demineraillzed water to make 1 liter. | |

The fixer is used without further dilution.

In this way 10 differing black-and-white developer solutions were prepared, called A,B,C, . . . to J. wherein as is clear from the figures in Table 1 A', B', D' and G' have the same composition as A, B, D and G respectively and are differing in that the black-and-white material processed therein is coated from the comparative cubic silver chloroiodide grains where an accent is added to the characters, whereas the characters are left unchanged if the material processed in the corresponding chemistry is coated from tabular silver chloroiodide grains used in the method of the present invention. The density as a function of the light dose was measured and therefrom were determined the following parameters:

fog level F (with an accuracy of 0.001 density), given in the Table 1 after multiplying the measured density with a factor of 1000;

the relative speed S at a density of 1 above fog (an increase of the said speed with a factor of 2 gives a speed value that is 0.30 lower as the relation is logarithmic and as less light is needed to get the desired density; said speed value is given in Table 1 after multiplication with a factor of 100), the maximum density DMAX (multiplied by a factor of 100);

the covering power C.P. corresponding to the value of DMAX, divided per gram of silver, measured after development.

TABLE 1

| Developer | x | y | F | S | DMAX | CP |
|---|---|---|---|---|---|---|
| A | 0 | 0 | 692 | 140 | 314 | 44.9 |
| A' | 0 | 0 | 2060 | 179 | 390 | 51.5 |
| B | 1 | 0 | 51 | 145 | 292 | 41.7 |
| B' | 1 | 0 | 80 | 165 | 366 | 48.3 |
| C | 1.5 | 0 | 56 | 148 | 278 | 39.7 |
| D | 1 | 0.03 | 47 | 146 | 331 | 47.3 |
| D' | 1 | 0.03 | 79 | 166 | 354 | 46.7 |
| E | 0 | 0.03 | 214 | 130 | 348 | 49.7 |
| F | 0 | 0.07 | 73 | 147 | 341 | 48.7 |
| G | 0 | 0.10 | 52 | 153 | 331 | 47.3 |
| G' | 0 | 0.10 | 142 | 168 | 329 | 43.4 |
| H | 0 | 0.13 | 51 | 157 | 332 | 47.4 |
| I | 0 | 0.16 | 41 | 161 | 328 | 46.9 |
| J | 0 | 0.20 | 42 | 164 | 315 | 45.0 |

x = KBr; y = 5-methyl-benzotriazole (expressed in g/l)

From Table 1 it can be concluded that in the presence of bromide ions but in the absence of methyl-benzotriazole fog decreases to a certain extent (compare developers A, B and C and A' and B' respectively) as well as covering power.

In the presence of bromide ions however speed and fog are decreased if the benzotriazole compound is present (compare developers D and B), but covering power is enhanced. For materials coated from emulsions having cubic crystals (see B' and D') covering power is however reduced to a considerable extent and covering power is higher for materials coated from emulsions having tabular grains now! In the absence of bromide ions the presence of increasing amounts of 5-methyl-benzotriazole even makes decrease covering power in a tremendous way for materials coated from emulsions having cubic silver chloroiodide grains.

A decrease of fog and an increase of speed however occurs in the absence of bromide ions if the benzotriazole compound is added in amounts as set forth in Table 1 (compare E and F with A, wherein for E and F the highest covering power is calculated).

In developer F, corresponding with a preferred embodiment of the method of this invention, the most suitable relationship is thus attained between fog-speed-contrast and covering power.

Example 2

The same emulsion having tabular grains rich in silver chloride as described in Example 1 was coated in the materials prepared in Example 2, except for the presence in the coating B of an amount of 3 mg per $m^2$ of 5-methyl-benztriazole in the protective layer, said protective layer further containing 1.3 g gelatine per $m^2$ per side on both sides of a polyethylene terephthalate film support having a thickness of 175 $\mu$m. Coating A was free from 5-methyl-benztriazole in the protective antistress layer.

The resulting black-and-white photographic materials A and B contained per side an amount of silver halide corresponding to 3.59 and 3.64 grams of $AgNO_3$ per $m^2$ respectively and an amount of gelatin corresponding to 2.8 g/$m^2$.

Samples of these coatings were exposed with green light of 540 nm during 0.1 seconds using a continuous wedge and were processed during the "90 seconds cycle" described below. The processing occurred in a black-and-white developer, the composition of which has been given hereinafter. The processing was run in the processing machine CURIX 330 (Agfa-Gevaert trade name product) within a total processing time of 60 seconds, developer and fixer being held at 35° C.

The processing composition for the black-and-white development of the silver halide materials A and B is given hereinafter:

| | |
|---|---|
| demineralized water | 700 ml |
| sodium erythorbate 1 aq. | 61.5 g |
| 4,4'-hydroxymethyl-methyl-phenidone | 2 g |
| potassium bromide | 0 g |
| potassium thiocyanate | 1 g |
| 5-chloro-benzotriazole | 0.14 g |
| aqueous potassium sulphite (655 g/l) | 0 ml |
| aqueous potassium carbonate (765 g/l) | 125 ml |
| aqueous potassium hydroxyde (755 g/l) | 10 ml |
| 1-hydroxy ethyl diphosphonic acid di-Na salt | 1 g |
| Polyethylene glycol (M.W.: 400) | 20 ml |
| pH (adjusted with acetic acid) | 9.65 |
| Water to make 1 l. | |

The concentrated low-sludge "ecological" black-and-white developer free from hardening agents, free from hydroquinone, free from bromide ions and free from sulphite should be diluted with the same amount of demineralized water (pH of developer ready-for-use: 10.46).

The composition of the fixer, used without further dilution, was the same as in Example 1.

Materials A and B were processed in the same way as in Example 1 in the "ecological" low-sludge developer and fixer described hereinbefore and the same sensitometric parameters as in Example 1 (see Table 1 and description above Table 1) were summarized in Table 2 hereinafter.

TABLE 2

| Material | F | S | DMAX | CP |
|---|---|---|---|---|
| A | 42 | 153 | 402 | 54.5 |
| B | 45 | 153 | 426 | 58.6 |

From Table 2 it can be concluded that in an ecological low-sludge developer (in the absence of sulphite, wherein sulphite is substituted by an erythorbic acid salt acting as an anti-oxidant and as a developing agent), wherein no bromide ions are present, but wherein an organic antifoggant as 5-chloro-benztriazole is present in low amounts (0.92 mmole per liter of developer), satisfying sensitometric results are obtained (good fog-sensitivity relationship) and an excellent maximum density and covering power.

Moreover if an organic compound inhibiting development, as 5-methyl-benztriazole in minor amounts of about 20–25 $\mu$mole/$m^2$ in material B, is present in the protective antistress layer, covering power is enhanced, without further remarkably influencing the fog-speed relationship.

We claim:

1. Method of processing an image-wise exposed light-sensitive black-and-white silver halide photographic material comprising a support coated on one or both sides thereof with hydrophilic layers, wherein at least one of said layers comprises one or more emulsions having tabular silver halide crystals rich in silver chloride, said method comprising the steps of developing, fixing, rinsing and drying, characterized in that said developing step proceeds in a black-and-white developer comprising one or more organic compounds inhibiting development and in that said developer is substantially free from bromide ions and from sulphite ions.

2. Method according to claim 1, wherein said organic compound(s) inhibiting development is(are) (a) benzotriazole compound(s).

3. Method according to claim 2, wherein said benzotriazole compound(s) has(have) a structure corresponding to the general formula (I), (I)

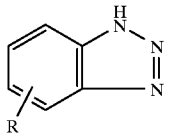

wherein R represents a hydrogen atom, a halogen, an alkyl group, an amino group, a hydroxy group, a carboxy group, a sulphonic acid group, an alkoxycarbonyl group, an acylamide group or a sulfonamide group.

4. Method according to claim 2, wherein said benzotriazole compound(s) is(are) selected from the group consisting of benzotriazole, 5-methylbenzotriazole, 4-methylbenzotriazole, 6-aminobenzotriazole, 5-chlorobenzotriazole, 5-carboxy-benzotriazole and 5-trifluoromethyl-benzotriazole.

5. Method according to claim 1, wherein said organic compounds inhibiting development are present in an amount of from 0.1 mmole up to 1 mmole per liter of developer ready-for-use.

6. Method according to claim 1, wherein said developer comprises developing agents selected from the group consisting of hydroquinone, ascorbic acid, reductic acid or derivatives thereof.

7. Method according to claim 1, wherein said developer further comprises thiocyanate ions in an amount of from 5 mmoles up to 25 mmoles per litre of developer ready-for-use.

8. Method according to claim 1, wherein said developer has a pH value of from 8.5 up to 10.3.

9. Method according to claim 1, wherein said developer is substantially free from hardening agents.

10. Method according to claim 1, wherein the said fixing step proceeds in a fixer which is substantially free from aluminum ions.

11. Method according to claim 1, wherein the said processing proceeds within a total processing time of 90 seconds or less.

12. Method according to claim 1, wherein the said tabular silver halide crystals rich in chloride are {111} tabular grains accounting for at least 50% of total projected area of all grains, having an average aspect ratio of more than 2 and an average grain thickness of from 0.05 up to 0.30 $\mu$m.

13. Method according to claim 1, wherein the said tabular crystals rich in silver chloride are crystals selected from the group consisting of silver chloride, silver chloroiodide, silver chlorobromide and silver chlorobromoiodide.

14. Method according to claim 1, wherein the said black-and-white photographic material further has a protective antistress layer comprising one or more organic compounds inhibiting development.

15. Method according to claim 14, wherein said organic compound(S) inhibiting development is (are) (a) benzotriazole compound(s).

16. Method according to claim 15, wherein said benzotriazole compound(s) has(have) a structure corresponding to the general formula (I), (I)

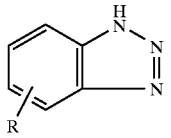

wherein R represents a hydrogen atom, a halogen, an alkyl group, an amino group, a hydroxy group, a carboxy group, a sulphonic acid group, an alkoxycarbonyl group, an acylamide group or a sulfonamide group.

17. Method according to claim 15, wherein said benzotriazole compound(s) is(are) selected from the group consisting of benzotriazole, 5-methylbenzotriazole, 4-methylbenzotriazole, 6-aminobenzotriazole, 5-chlorobenzotriazole, 5-carboxy-benzotriazole and 5-trifluoromethyl-benzotriazole.

18. Method according to claim 14, wherein said organic compounds inhibiting development are present in the protective antistress layer in an amount of from 0.001 mmole up to 0.010 mmole per gram of silver, expressed as an equivalent amount of silver nitrate, coated per square meter of the said material.

19. Method according to claim 1, wherein further replenishing in the said developing and/or fixing step proceeds with developer and/or fixing replenishing solutions in amounts per $m^2$ of processed material of 200 ml or less.

* * * * *